US006499654B1

(12) United States Patent
Huff et al.

(10) Patent No.: US 6,499,654 B1
(45) Date of Patent: Dec. 31, 2002

(54) POSTCARD FOR CARRYING COMPACT DISK

(75) Inventors: Susan Marie Huff, Cortez, CO (US); Scott Dale Huff, Cortez, CO (US)

(73) Assignee: The Scene Production, Cortez, CO (US)

( * ) Notice: Subject to any disclaimer, the term of this patent is extended or adjusted under 35 U.S.C. 154(b) by 0 days.

(21) Appl. No.: 09/917,579

(22) Filed: Jul. 27, 2001

Related U.S. Application Data

(63) Continuation-in-part of application No. 60/221,130, filed on Jul. 27, 2000.

(51) Int. Cl.[7] ..... B42D 15/00

(52) U.S. Cl. ..... 229/92.8; 206/308.1; 206/308.3; 206/497

(58) Field of Search ..... 229/92.8; 206/307, 206/308.1, 308.3, 497

(56) References Cited

U.S. PATENT DOCUMENTS

| | | | | | |
|---|---|---|---|---|---|
| 2,010,867 | A | * | 8/1935 | Kubo | 229/92.8 |
| 2,256,399 | A | * | 9/1941 | MacHarg | 229/92.8 |
| 2,363,472 | A | * | 11/1944 | Ritter | 229/92.8 |
| 3,321,860 | A | | 5/1967 | Dichtl et al. | |
| 3,713,238 | A | | 1/1973 | Hyman et al. | |
| 4,890,402 | A | | 1/1990 | Carroll | |
| 5,101,973 | A | * | 4/1992 | Martinez | 206/308.1 |
| 5,288,011 | A | * | 2/1994 | Yoshioka et al. | 229/92.8 |
| 5,590,912 | A | * | 1/1997 | Stevens | 206/308.1 |
| 5,593,030 | A | | 1/1997 | Tell | |
| 5,624,265 | A | | 4/1997 | Redford et al. | |
| 5,641,116 | A | | 6/1997 | Martin | |
| 5,662,217 | A | | 9/1997 | Durr | |
| 5,669,165 | A | * | 9/1997 | Santorsola | 116/316 |
| 5,690,220 | A | | 11/1997 | Swan | |
| 5,697,496 | A | | 12/1997 | Bauer | |
| 5,713,462 | A | | 2/1998 | Hansen | |
| 5,713,605 | A | * | 2/1998 | Pace et al. | 206/308.1 |
| 5,722,538 | A | * | 3/1998 | Neely et al. | 156/277 |
| 5,775,490 | A | | 7/1998 | Baker et al. | |
| 5,775,492 | A | * | 7/1998 | Ban | 206/308.1 |
| 5,799,784 | A | | 9/1998 | Bosworth | |
| 5,806,672 | A | | 9/1998 | Bosworth | |
| 5,819,928 | A | | 10/1998 | Wynalda, Jr. | |
| 5,857,565 | A | * | 1/1999 | Baker et al. | 206/232 |
| 5,887,905 | A | | 3/1999 | Collins | |
| 5,971,157 | A | | 10/1999 | Howell et al. | |
| 5,992,731 | A | | 11/1999 | Tani | |
| 6,059,102 | A | | 5/2000 | Gelardi et al. | |
| 6,068,116 | A | * | 5/2000 | Bankhead | 206/232 |
| 6,079,557 | A | | 6/2000 | Lammerant et al. | |
| 6,082,033 | A | | 7/2000 | Skinner | |
| 6,106,023 | A | | 8/2000 | Sud et al. | |
| 6,126,201 | A | * | 10/2000 | Pace et al. | 206/308.1 |
| 6,182,823 | B1 | | 2/2001 | Rinde | |
| 6,241,417 | B1 | | 6/2001 | Schlutius | |
| 6,349,823 | B1 | * | 2/2002 | Innis | 206/308.1 |

* cited by examiner

*Primary Examiner*—Jes F. Pascua
(74) *Attorney, Agent, or Firm*—Holme Roberts & Owen, LLP

(57) ABSTRACT

The present invention includes a postcard for carrying a disk medium, such as a compact disk or digital video disk, through the mails. In a preferred embodiment, the postcard includes a first sheet, which contains, on its front side, an area for an image or message, and a means for attaching a disk medium. The means for attaching a disk medium is preferably a clear plastic pocket. The postcard includes a filler card and optionally an insert sheet, which are placed next to the first sheet. The postcard is covered by a transparent plastic layer preferably applied by a shrink wrap process enclosing the first sheet, filler card, and insert, if any. The area for providing postal information is preferably a paper label applied adhesively to the back side of the postcard over the transparent plastic layer.

9 Claims, 6 Drawing Sheets

POSTCARD FOR CARRYING COMPACT DISK

PRIORITY

This non-provisional application is a continuation-in-part and claims priority from, and incorporates by reference, provisional application No. 60/221,130 with a filing date of Jul. 27, 2000.

SMALL-ENTITY STATUS

The Assignee, under Rule 37 CFR 1.27, for this non-provisional application is a small entity.

FIELD OF THE INVENTION

The field of the invention is postcards for sending messages through the mail.

BACKGROUND OF THE INVENTION

Greeting cards are configured to convey messages from a sender to a recipient in various ways. A variety of folded greeting cards have been developed, which display images and/or preprinted written messages, and ordinarily provide space where the sender can write a personal message. Such greeting cards may be designed to hold a photograph, a compact disk, or other flat item by insertion into a slot or flap in one page of the card. To ensure safe transport through the mail, folded greeting cards must be inserted within an envelope or other wrapper before mailing. The contents, including a photograph, compact disk, or other item, are typically not visible once the envelope or wrapper is sealed, unless the envelope or wrapper has a window or similar arrangement. Envelopes with window arrangements can be complicated to manufacture and often involve additional expense; they also often do not provide a clear, complete view of the item to be displayed.

Postcards ordinarily constitute a single, stiff page or card, that is flat and not folded, and that includes a front side having an image, such as a scene of a famous landscape, and a back side having space where the sender can provide postal information, including the recipient's name and postal address and a postage stamp or mark with processing information, and also an area where the sender can write a personal message. The space for writing personal messages or for providing text, such as a written description of the scene on the front side of the postcard, is ordinarily very limited. Additionally, because a conventional postcard is not enclosed in an envelope or other wrapper, and is not folded to protect is contents, it is difficult to attach additional material or items which contain a further message or image, and which will not become detached, or cause the postcard to adhere to other mail or become jammed in postal service sorting and reading machinery.

SUMMARY OF THE INVENTION

The present invention is a postcard that includes a means for attaching a compact disk or other similar disk medium, including a digital video disk, multi-laminate disk, or Smartcard, to the postcard. The invention also contemplates attaching a microchip to a postcard. In one embodiment, the postcard of the invention includes a first single sheet, preferably formed from cardstock, having a front side and a back side. The front side includes a first area with a message or a scenic, graphic or artistic image, and a second area with a means for attaching disk media, such as a compact disk, digital video disk or other similar disk medium. In the present embodiment, the back side is blank, although in other embodiments, the back side may include various information, messages, and images, as desired by the manufacturer. The means for attaching a disk medium is preferably a pocket affixed to the front side of the first sheet, having an opening, such as a slit or perforation, through which a compact disk or digital video disk, or other disk medium, can be inserted into or removed from, the pocket. The pocket can be any of several pocket arrangements for holding a disk or other similar medium, the pocket preferably made of a plastic, although other materials such as paper or foil may be used. The pocket is preferably transparent, to permit a purchaser to see the compact disk or other disk medium and relate that to the image also found on the front side of the card. The pocket preferably is sized so that its width and length are slightly larger than the diameter of the disk medium, to snugly hold the disk but also to allow room for easy insertion and/or removal. In one embodiment, the pocket has a back sheet and a front sheet, both formed from clear plastic, bound together to form a cavity in which the disk is held. The pocket is affixed to the front side of the postcard with an adhesive. A slit or perforation in the pocket is used to insert the disk medium and/or remove it from the pocket. In this embodiment, the postcard also includes a filler card, preferably formed of stiff chipboard or cardboard, placed behind the first sheet, to provide support to the first sheet and its attached disk medium. The filler card is preferably not attached or affixed to the first sheet, although in certain embodiments it may be attached to the first sheet with glue or another adhesive. The postcard also includes a thin layer of transparent plastic, preferably a shrink wrap application, covering the postcard, including the first sheet and the filler card, and the pocket, forming a protective layer over the pocket and its contents, and holding the first card and the filler card together. This layer reduces the risk that the pocket, and other parts of the postcard, may become snagged or caught in postal machinery or other mail. Also in this embodiment, a label is affixed to the back side of the postcard, on top of the plastic layer, the label providing a surface for writing address information and personal messages. The label is preferably a paper label with an adhesive backing. In a preferred embodiment, an insert sheet is included in the postcard, positioned between the filler card and the plastic layer, the insert sheet including instructions for use of the disk medium.

In another embodiment of the invention, the postcard includes a single sheet of card stock, having a front side and a back side. In this embodiment, the invention does not include a filler card. This embodiment of the invention is otherwise the same as the embodiment described above. The invention includes a method for making a postcard carrying a disk medium such as a compact disk.

In a preferred embodiment, the content of the disk medium and the message or image on the front side of the card are coordinated. Preferably also, the invention includes a compact disk which contains a video, audio, slide show or multimedia presentation. The compact disk may contain a greeting, including a greeting from the sender, a description of a scenic location or event, or other presentation, which is coordinated with an image displayed on the postcard. As noted above, the pocket is preferably transparent, which enhances the marketing value of the postcard, enabling a potential buyer to see the image of the first area and to understand that the disk medium of the second area will provide multiple images, a sound narrative, and perhaps music further describing the image shown. For example, a resort may use the postcard of the present invention as a marketing tool to display an image of a lodge owned by the resort, and also to provide much more information for potential visitors via a compact disk video presentation of the amenities offered by the lodge as well as recreational activities available in the surrounding area. The present invention may also be sold as a souvenir postcard for tourists or visitors, having an image of a scenic landscape on one area of the front side of the card, and a compact disk on a second area of the front side of the card, the compact disk providing a further description of the history, natural features, and geologic importance of the landscape.

DETAILED DESCRIPTION OF THE DRAWINGS

Figure 1:
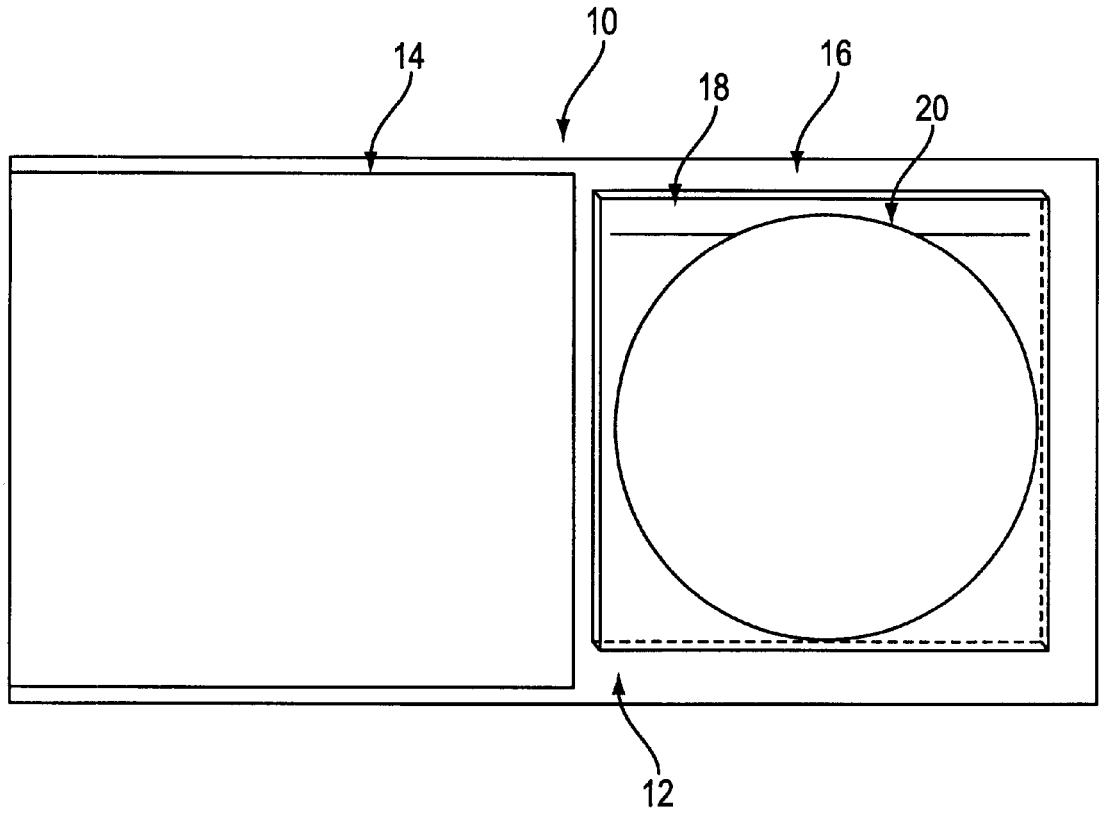
FIG. 1, depicting the front side of a postcard of one embodiment of the invention.
Figure 2:
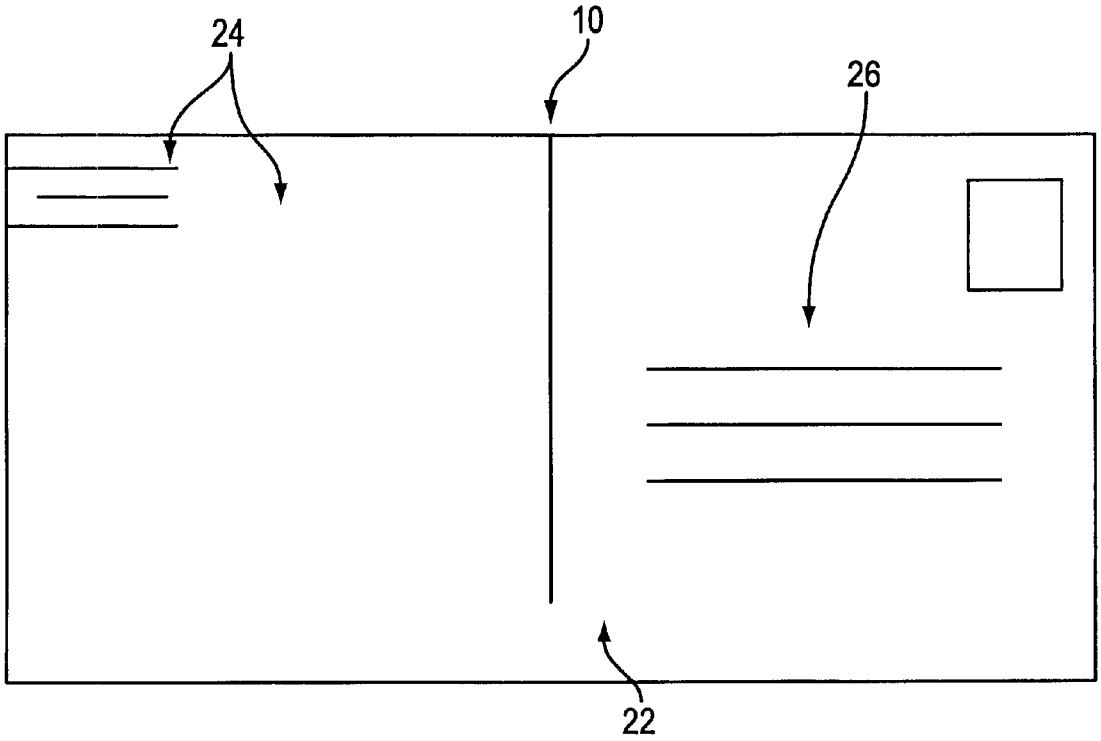
FIG. 2, depicting the back side of the embodiment of FIG. 1.

The present invention is a postcard, formed to carry a compact disk or other disk medium through the mail. The postcard may be of any size allowed by postal regulations, and will typically include one or more single, stiff sheets or cards, usually of rectangular shape, as described in greater detail below. The postcard sheets and cards may be made of paper, plastic, or other material that can withstand postal processing. In one embodiment of the invention, as displayed in FIG. 1, the postcard 10 is a single sheet, that has a front side 12, including a first area 14 and a second area 16. The first area 14 displays an image and/or a greeting, and the second area 16 includes a means 18 for attaching a disk medium 20, to the postcard 10. The disk medium may be a compact disk, digital video disk, multi-laminate disk, or other disk medium. Also, the invention can attach other media and items such as a Smartcard, or a microchip. As depicted in FIG. 2, the back side 22 of the postcard 10 has a first area 24 for postcard text, such as a description of the image found on the front side, and the sender's written message, and a second area 26 for postal information, including the recipient's name and address and a stamp or postal bar code and other communications to the postal authorities. More or less space may be devoted to postcard text and the sender's written message depending on the design preferences of the card manufacturer. In some embodiments, there may be no space provided for postcard text or a personal message. In a preferred embodiment, the area for postcard text and/or personal message and the area for postal information are found on a label that is attached to the backside of the postcard, although in other embodiments this may be found on the backside of the postcard.

In other embodiments of the invention, the front side of the postcard may include only an image or greeting, and the means for attaching a disk medium may be located on the back side of the postcard.

Figure 3A:
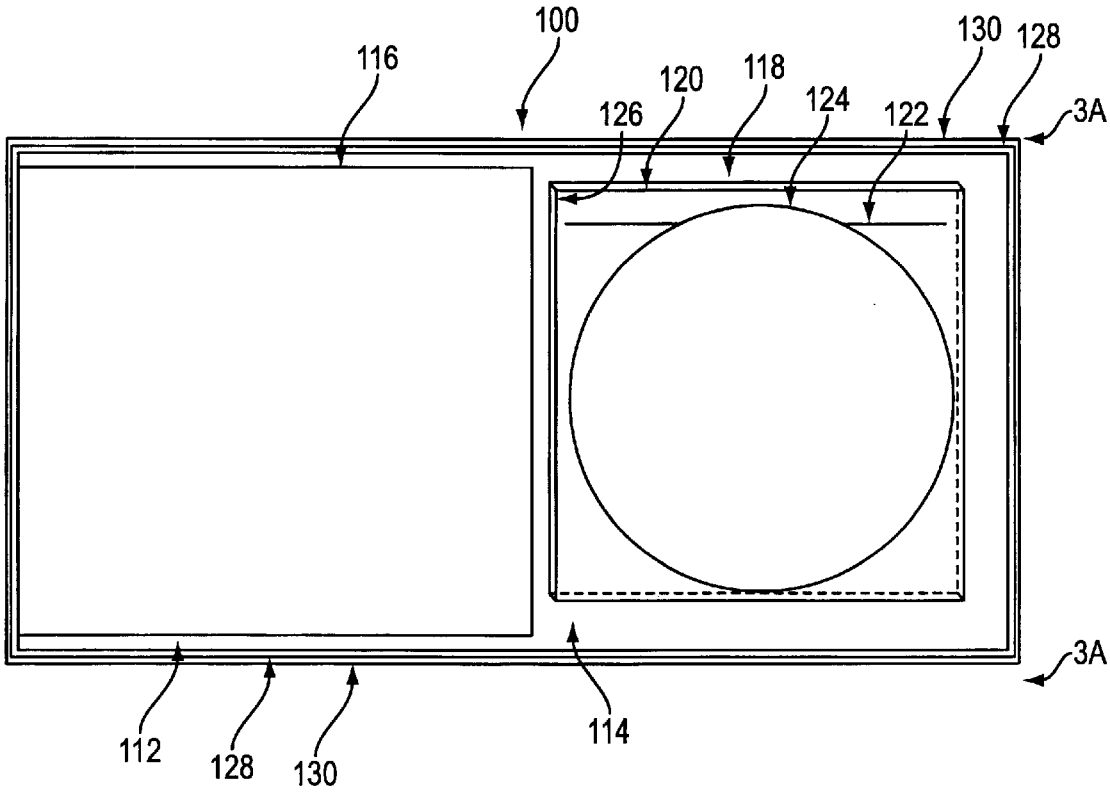
FIG. 3A, depicting a further embodiment of the invention, including a postcard with a front side having a first area for displaying an image and a second area in which a compact disk is releasably attached to the postcard.
Figure 3B:
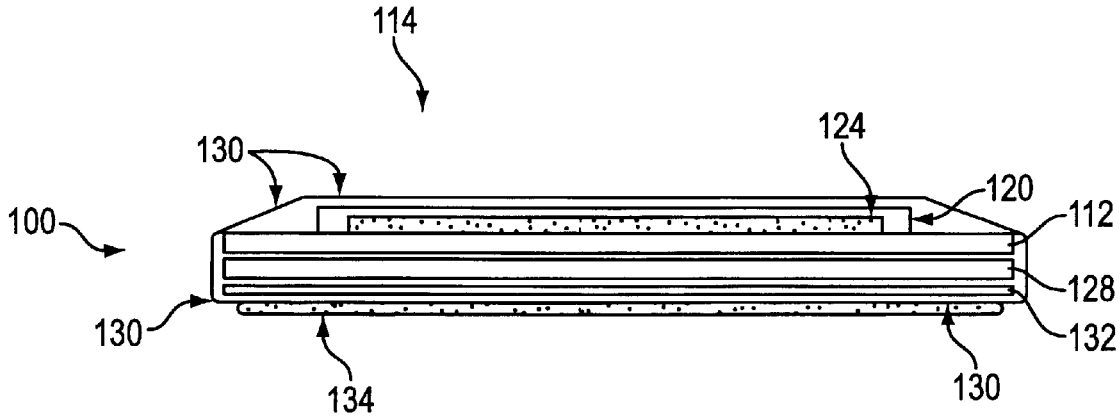
FIG. 3B, depicting a cross-sectional view of the postcard of FIG. 3.
Figure 3C:
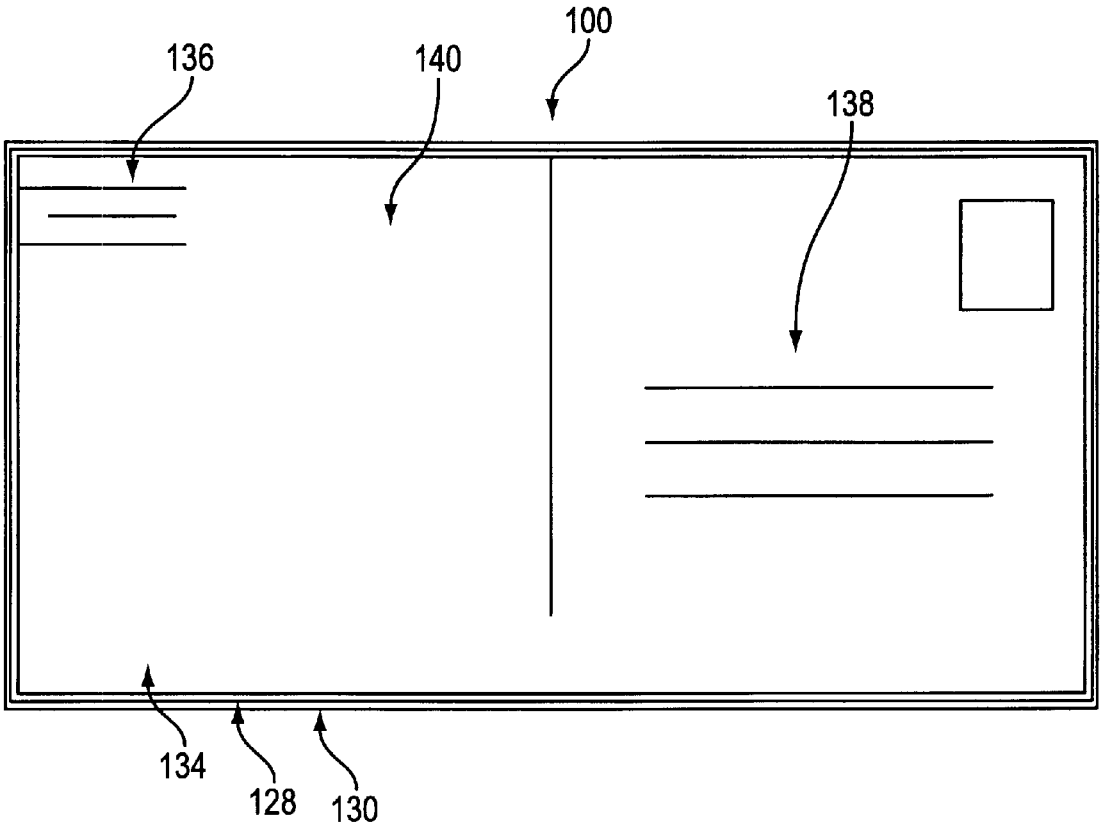
FIG. 3C, depicting the back side of the postcard of FIG. 3.
Figure 4:
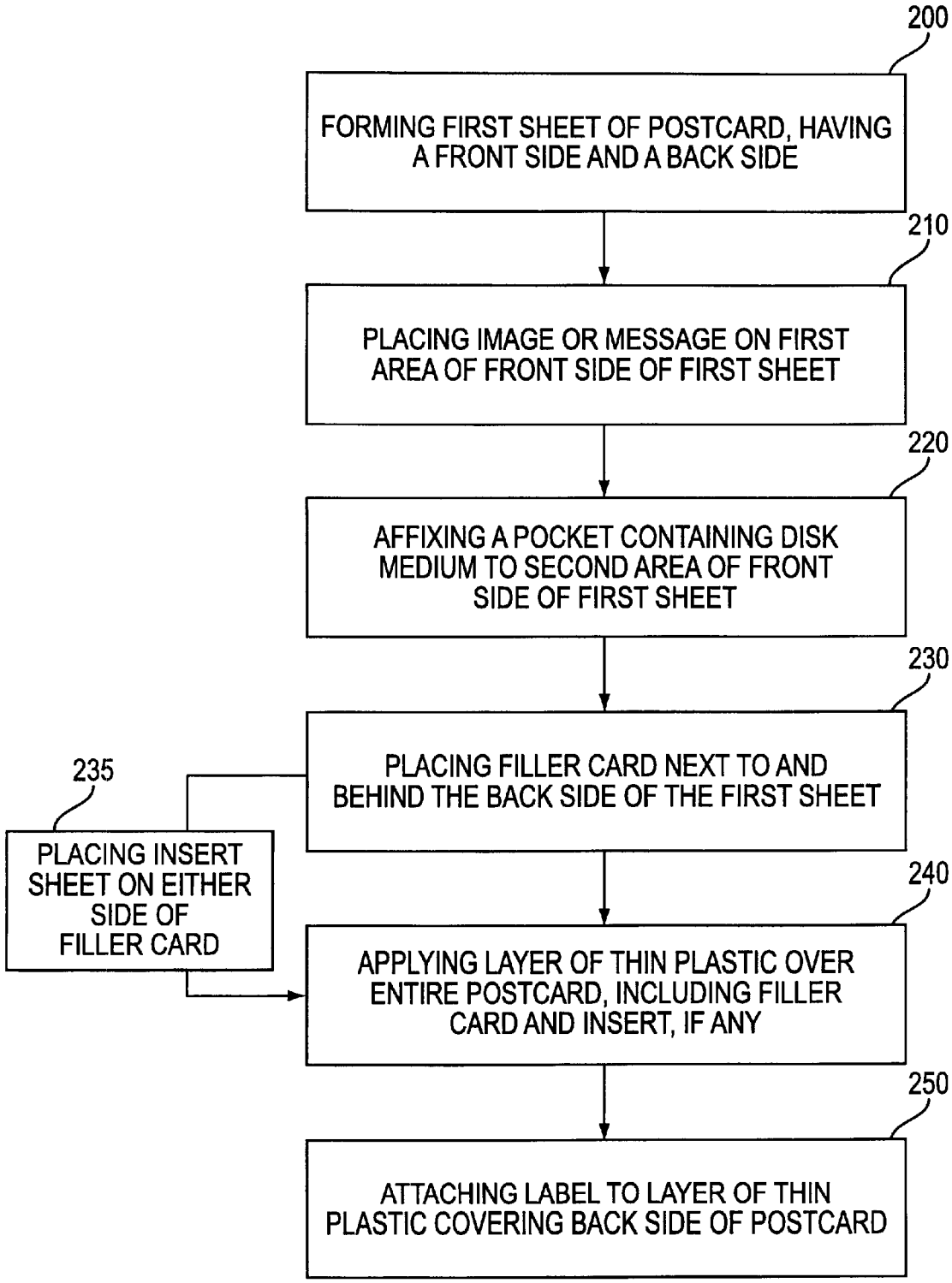
FIG. 4, depicting a flow diagram of a method for forming a postcard of the present invention.

FIG. 3 depicts another embodiment of the postcard of the invention. In this embodiment, the postcard 100 includes a first sheet 112, preferably formed of cardstock, having a front side 114, to be viewed by the consumer. The front side 114 of the postcard 100 includes a first area 116 for an image or message, and a second area 118, which includes a pocket 120 attached to said postcard 100, having a slit 122 for inserting the disk medium 124 into the pocket 120, or removing it from the pocket 120. In the embodiment depicted, the disk medium 124 is a compact disk. The pocket 120 is preferably made of a thin, flexible material sized to snugly hold the compact disk. The pocket 120 is affixed to the front side 114 of the postcard 100. The pocket 120 is preferably formed from a sheet 126 of thin flexible material, such as plastic, folded and sealed to form a cavity in which the disk medium 124 is held. The pocket 120 may be formed from other flexible materials, such as paper or foil. Preferably, the pocket is transparent, and clear plastic is accordingly a preferred material for the pocket 120. The length of the slit 122 is slightly greater than the diameter of the disk medium 124 and its width is slightly greater than the diameter of the disk medium 124. As shown in FIG. 3, the slit 122 is on the outer face of the pocket 120, although it may be located at the top of the pocket 120 or in other locations as may facilitate ease of removal of the disk medium 124 from the pocket 120, or insertion of the disk 124 into the pocket 120.

In a preferred embodiment, the postcard also includes a filler card 128, placed behind the first sheet 112, to provide support to the first sheet 112. The filler card 128 is formed from a stiff material such as chipboard or cardboard, although other paper products or plastic material may be used. Preferably, the filler card 128 has a weight in excess of 20 point; 40 point chipboard or cardboard is preferred, to enhance support provided to the first sheet 112 and compliance with postal regulations. The filler card 128 is preferably the same size as the first sheet 112, although the size of the filler card 128 may vary from that of the first sheet 112. In this embodiment, a thin sheet or film of plastic 130 is placed over to cover and enclose the first sheet 112 and the filler card 128. This plastic sheet 130 holds the first sheet and filler card together and provides a second layer, in addition to the pocket 120, that further protects the disk medium 124 while the postcard 100 is in transit. The plastic sheet 130 is preferably transparent, and is preferably attached snugly to the postcard 100 by a shrink wrap process. The plastic sheet preferably encloses the entire card. Other methods of attaching an outer layer of plastic may be used, including hot sealing the outer edges or folded edges of the plastic.

The pocket 120 may be constructed in any of various ways known by those familiar with packaging compact disks and other disk media. In any of these methods, a slit or perforation, or an opening with a flap over it, may be cut in the material of the pocket to permit a disk to be inserted or removed. Alternatively, the pocket may be formed around a disk, and a slit created only for removal of the disk. The compact disk may be of any size compatible with a postcard that meets postal regulations. The preferred size for a disk of the present invention is a 3¼ inch miniround, although other sizes may be used. As noted above, other forms of disk media may be used, including digital video disks, and multi-laminate disks. In addition, it is contemplated that a Smartcard or similar information-bearing card may be attached to the postcard of the present invention. A message, image or design may be displayed on the disk medium, for example, to relate the disk medium with the image or message on the front side of the postcard. As a further embodiment, a microchip or microchip-bearing substrate may be attached to the postcard of the present invention or, in another embodiment, may be embedded in the first sheet or filler card, in one or more areas, alone or in combination with a disk medium attached as envisioned by the invention.

FIG. 3A depicts a cross-sectional view of the postcard of FIG. 3 with the front side 114 of the postcard 100, containing the pocket 120 and disk medium 124 facing up. The pocket 120 is attached to the first sheet 112 of the postcard 100. The pocket 120 surrounds the disk medium 124. The filler card 128 is positioned beneath the first sheet 112. An insert sheet 132, containing instructions for the disk medium 124 and/or other information, is then placed beneath the filler card 128, although alternatively the insert sheet 132 may be placed between the first sheet and the filler card. The use of an insert sheet is optional in the present invention, and an alternative embodiment does not include the insert sheet. A thin plastic sheet 130, preferably attached through a shrink wrap process, covers the pocket 120, the first sheet 112 and the filler card 128, and any insert sheet 132. The plastic sheet 130 acts to protect the pocket 120 and its contents, and creates a smooth surface that reduces the risk that the pocket 120 or any other part of the postcard 100 will snag or become caught in postal machinery or other mail. In a preferred embodiment, a label 134 is affixed to the outside-facing surface of the thin sheet of plastic 130 on the back side of the postcard (the side opposite the side carrying the disk medium 124). The label 134 provides a surface on which postcard text, and/or a personal message, and postal information is provided. The label 134 is preferably comprised of paper that is compatible with ink and postage stamps, and has an adhesive backing that permits easy attachment to the plastic sheet 130.

FIG. 3B depicts the back side of the postcard 100 of FIG. 3. In this view, the label 134 is affixed to the plastic sheet 130, which covers and encloses the first sheet (not shown), the filler card 128, any insert sheet (not shown), and the pocket and disk medium (not shown). The label 134, contains the postcard text 136 and postal information 138, and any desired space for a personal message 140.

In a preferred embodiment, the disk medium is a compact disk and the content of the compact disk is coordinated with the image or message displayed on the postcard. The compact disk may include a video or audio recording. Alternatively, the compact disk may include a prepared video or audio presentation, slide show, or multimedia presentation, that includes a narrative and/or music.

The invention further includes a method for attaching a compact disk or other medium to a postcard. The method includes a step 200 of forming a first sheet, having a front side and back side, of the postcard, preferably of card stock, although other materials, such as plastic or other paper products may be used. The method includes a step 210 of placing an image or message on a first area of the front side of said first sheet. The method includes a step 220 of affixing a pocket containing a compact disk or other disk medium to a second area of the front side of said first sheet. The method includes a step 230 of placing a filler card next to and behind the back side of the first sheet so that the two are in contact. In the present embodiment, the first sheet and filler card are not attached (such as through glueing or other adhesives), but in another embodiment the first sheet and filler card may be attached together. The separate filler card is used to accomplish acceptable stiffness and support for the postcard, while not adding such additional thickness and weight to the first sheet. Using thicker card stock for the first sheet could interfere with the printing process needed to place an image on the card stock. Preferably, the filler card is formed of a single, unfolded sheet of cardboard or chipboard in excess of 20 point weight, and preferably is comprised of 40 weight point cardboard or chipboard. A stiffer cardboard or chipboard provides a stronger support for the first sheet, is less likely to curl or warp, and is more likely to cause the invention to be acceptable to postal authorities. In a preferred embodiment, the first sheet and filler card are approximately the same size and shape. While various sizes and shapes may be used, the preferred shape is rectangular, having a length about 8 inches and width of about 3.75 inches. The method includes a step 240 of applying a layer of thin plastic, such as a plastic sheet or film, over the entire postcard, including the first sheet and the pocket, and the filler card, preferably through a shrink wrap process. The method also includes a step 250 of attaching a label to the backside of said postcard, to the layer of thin plastic, said label providing areas for postcard text, if desired, for writing the recipient's name address, and affixing a stamp or other information for postal processing, and/or an area for writing a personal message. The label may be an adhesive label, having an adhesive backing which adheres to the postcard, or it may be attached by applying glue. The label may be comprised of paper, plastic or other material suitable for absorbing and retaining ink, and for holding a postage stamp. The label is preferably a paper label with an adhesive backing. The method includes an optional step 235 of placing an insert sheet into the post card, which contains instructions for using the compact disk or other medium. The insert is placed on either side of the filler card, preferably in contact with the filler card, but not attached to it, and, then, in step 240, the entire card, including the insert, is covered with a layer of thin plastic, according to step 240 and the label is attached according to step 250.

We claim:

1. A postcard, comprising:

a single card stock sheet, having a front side and a back side;

a first area for displaying an image or message, said first area located on said front side;

a second area, also located on said front side, said second area including a means for attaching a disk medium to said front side;

a filler card, positioned next to and having one side in contact with the back side of said card stock sheet;

a transparent layer of plastic applied to cover and enclose said single sheet and said filler card; and a label for providing postal information, permitting said postcard to reach its intended destination through the mail, attached to said transparent layer covering the side of said filler card opposite said card stock sheet.

2. The postcard of claim 1, wherein said disk medium is a compact disk.

3. The postcard of claim 1, wherein said disk medium is a multi-laminate disk.

4. The postcard of claim 1, wherein a microchip is attached to said front side instead of a disk medium.

5. The postcard of claim 1, wherein said means for attaching a disk medium is a pocket affixed to said front side.

6. The postcard of claim 5, wherein said pocket is comprised of plastic and is transparent.

7. The postcard of claim 5, further comprising a disk medium contained within said pocket.

8. The postcard of claim 1, wherein said transparent layer of plastic is applied through a shrink wrap process.

9. The postcard of claim 1, wherein the image or message of said first area is coordinated with the content of said disk medium.

* * * * *